US005564525A

United States Patent [19]

Dunnegan et al.

[11] Patent Number: 5,564,525

[45] Date of Patent: Oct. 15, 1996

[54] METHOD AND APPARATUS FOR TRANSPORTING NEW AND SPENT LIQUIDS

[76] Inventors: Garry W. Dunnegan, 1310 Gretchen St., Wichita, Kans. 67207; Gary Cain, 1064 N. 150 Rd., Baldwin City, Kans. 66006

[21] Appl. No.: 254,897

[22] Filed: Jun. 6, 1994

[51] Int. Cl.[6] ..... F16C 3/14; F16N 33/00

[52] U.S. Cl. ..... 184/1.5; 184/106; 141/98; 220/573

[58] Field of Search ..... 184/1.5, 105.1, 184/106; 141/98; 220/571, 573

[56] References Cited

U.S. PATENT DOCUMENTS

| | | | |
|---|---|---|---|
| 3,410,438 | 11/1968 | Bartz | 184/106 |
| 4,403,692 | 9/1983 | Pollacco | 141/98 |
| 4,488,584 | 12/1984 | Hestehave et al. | 220/573 |
| 4,524,866 | 6/1985 | Pollacco | 220/573 |
| 4,823,947 | 4/1989 | Maynard, Jr. | 141/98 |
| 4,881,650 | 11/1989 | Bartz | 220/573 |
| 4,974,647 | 12/1990 | Eastom | 220/573 |
| 5,082,035 | 1/1992 | Maxwell | 141/98 |

*Primary Examiner*—Thomas E. Denion
*Attorney, Agent, or Firm*—John W. Carpenter

[57] ABSTRACT

A method and apparatus for transporting a new fluid from a point of origin to a destination where a used fluid and a used filter are located. The used filter and the used fluid are to be obtained and to be disposed in a container after the new fluid has been removed from the container. The apparatus comprises a container having a hollow body for containing said fluids, and a pair of apertures for pouring fluids into and from the container. The container containing a new or unspent fluid is transported from an origin or source to a destination. The new fluid is poured from the container and into an engine. The used fluid from the engine is disposed into the container, along with any associated filters from the engine, and the container containing the used filter totally immersed in the used fluid is transported to the origin or source.

20 Claims, 3 Drawing Sheets

METHOD AND APPARATUS FOR TRANSPORTING NEW AND SPENT LIQUIDS

1. Field of the Invention

This invention relates to containers for the marketing of motor oils and similar products; and is particularly concerned with an improved container system that permits the collection of used products (e.g., motor oils and their associated filters, such as oil filters).

2. Description of the Prior Art

Motor oils, transmission fluids, engine coolants, and similar automotive fluids, along with any associated filters, must be replaced at regular intervals. This has generally been done by personnel at service stations and garages and by motorists themselves. One problem that arises in connection with such activities is that of disposing of the waste oil or other fluid and any used filters (such as oil filters). A recent survey showed that only a small percentage of the waste oil and used filters (e.g., oil filters) generated each year as the result of oil changes is returned to service stations or other collection points for recycling. Much of the rest of this used oil and used filters are discharged into sewer systems or disposed of in garbage collection systems, even though such disposal is prohibited by ordinance or statute in many areas. Serious pollution problems and fire hazards have on occasion arisen as the result of these practices.

The market has led to the development of oil change kits for sale at service stations and other outlets. The kits offered generally consisted of five 1 quart cans of motor oil packaged in a carrier. More recently some kits have included plastic bags or similar low cost containers into which the used oil can be poured and secured. Such bags are difficult to handle and are easily ripped or torn. The kits do not offer any means for receiving and transporting any used filters, especially for recycling purposes. Pouring the used oil into bulk storage is awkward at best. In many cases the bags or similar low cost containers do not prevent leakage or spilling of the oil. As a result of these and related problems, efforts to promote the use of plastic bags or similar low cost containers for the return of used oil to service stations or other suitable collection points have met with only limited success. Similar problems are encountered in the disposal of transmission fluids, engine coolants and the like, and used filters such as oil filters and the like. Therefore, what is needed and what has been invented is an improved method and apparatus (i.e., a container) for transporting new and spend liquids (e.g., used oil) along with used filters (e.g., used oil filters).

SUMMARY OF THE INVENTION

The present invention accomplishes its desired objects by broadly providing a self-contained method for providing a new or fresh fluid, collecting a used fluid, and returning the used fluid and a used filter to an original point. The method comprises providing at an origin a generally hollow container containing fresh liquid and including a first aperture having a first diameter and covered by a first cap that is secured to said container and a second aperture having a second diameter covered by a second cap that is secured to said container. The second diameter is dimensioned to receive therethrough a used filter. The container and the fresh fluid are transported to a destination point where an engine containing used fluid and a used filter is located. The used fluid is withdrawn or drained from the engine and captured in a catch pan, and the used filter is removed from the engine. A new filter is installed, and fresh fluid is disposed in the engine by removing the first cap off of the first aperture of the container and pouring the fresh fluid through the first aperture of the container and into the engine. The second cap is removed off of the second aperture of the container and the used filter is disposed into the container by passing the used filter through the second aperture of the container. The used fluid is then poured into the container, thereby immersing the used filter. The first and second caps are secured to the first and second apertures, respectively, and the container, which includes the used filter immersed in the used fluid, is returned to the origin.

The present invention further accomplishes its desired objects by providing a method for dispensing fresh liquids into an engine at a destination point and for collecting used liquids and used filters from the engine comprising the steps of:

(a) draining at a destination point used fluid from an engine;

(b) removing a used filter from the engine;

(c) pouring fresh fluid from a container into the engine;

(d) disposing the used filter of step (b) in the container of step (c) after said fresh fluid has been poured from the container; and (e) pouring the used fluid into the container such that the used filter is immersed in the used fluid.

The present invention further still accomplishes its desired objects by providing a method for transporting fresh motor oil from a point of origin to a destination point and for dispensing the fresh motor oil into an engine of a motor vehicle at the destination point and collecting used motor oil and a used oil filter from the engine at the destination point and for transporting the used motor oil and used filter back to the point of origin, comprising the steps of:

(a) providing at a point of origin a generally hollow container containing fresh motor oil and including a first aperture covered by a first cap secured to the container and a second aperture covered by a second cap secured to the container;

(b) transporting the container of step (a) from the point of origin to a destination point having an engine containing used motor oil and a used oil filter;

(c) removing at the destination point a drain plug from a drain opening of the engine such that the used motor oil is capable of draining out;

(d) draining the used motor oil into a drain pan;

(e) securing the drain plug into the drain opening of the engine;

(f) removing the first cap off of the first aperture of the container;

(g) removing at the destination point the used oil filter from the engine and securing a new filter to the engine;

(h) pouring the fresh motor oil contained in the container, through the first aperture of the container and into the engine;

(i) removing the second cap off of the second aperture of the container;

(j) passing the removed used oil filter of step (g) through the second aperture of the container for disposing the removed used oil filter in the container;

(k) pouring the used motor oil of step (d) from the drain pan and into the container of step (j) containing the removed used oil filter;

(l) securing the first cap to the container and over the first aperture;

(m) securing the second cap to the container and over the second aperture; and (n) returning the container, which includes the used oil filter immersed in the used motor oil, to the point of origin of step (a).

The present invention further still accomplishes its desired objects by broadly providing a container for transporting a spent fluid and a filter comprising a pair of opposed sides having edges thereof secured to edges of a pair of opposed ends and being supported and secured to a bottom and a top. The top of the container comprises a first aperture and a second aperture respectively having a first cap and a second cap removably secured thereto. The second aperture is larger than the first aperture and is dimensioned to receive therethrough a cylindrical object. (i.e. a used oil filter or the like). The container contains spent fluid and a used filter immersed in the spent fluid.

It is therefore an object of the present invention to provide an improved method and apparatus for transporting new and spent liquids.

These, together with the various ancillary objects and features which will become apparent to those skilled in the art as the following description proceeds, are attained by this novel apparatus and method, preferred embodiments thereof shown with reference to the accompanying drawings, by way of example only, wherein;

DETAILED DESCRIPTION OF THE INVENTION

Figure 1:
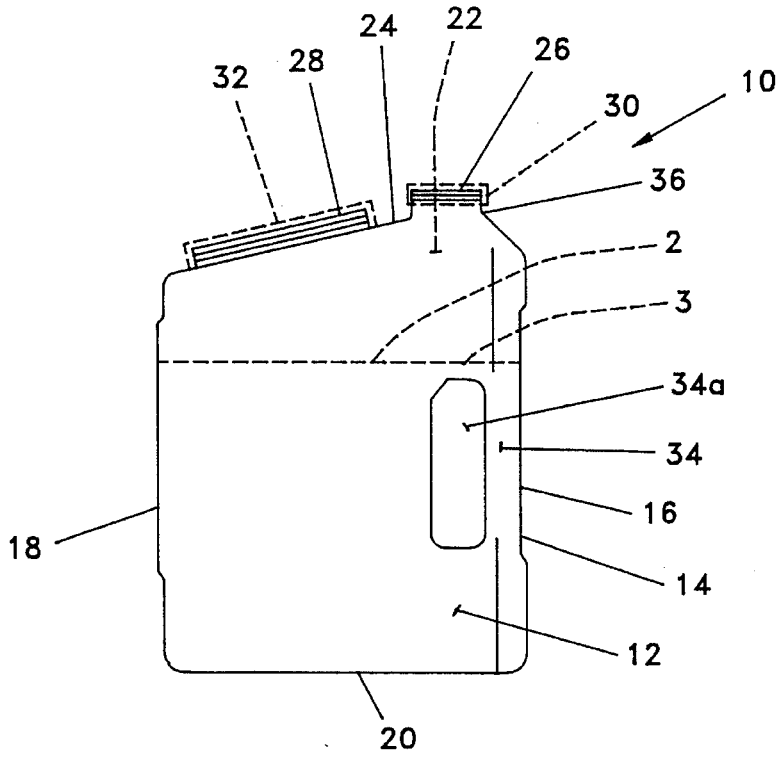
FIG. 1 is a side elevational view of the container of the invention, having dashed lines representing removable first and second caps thereof.
Figure 7:
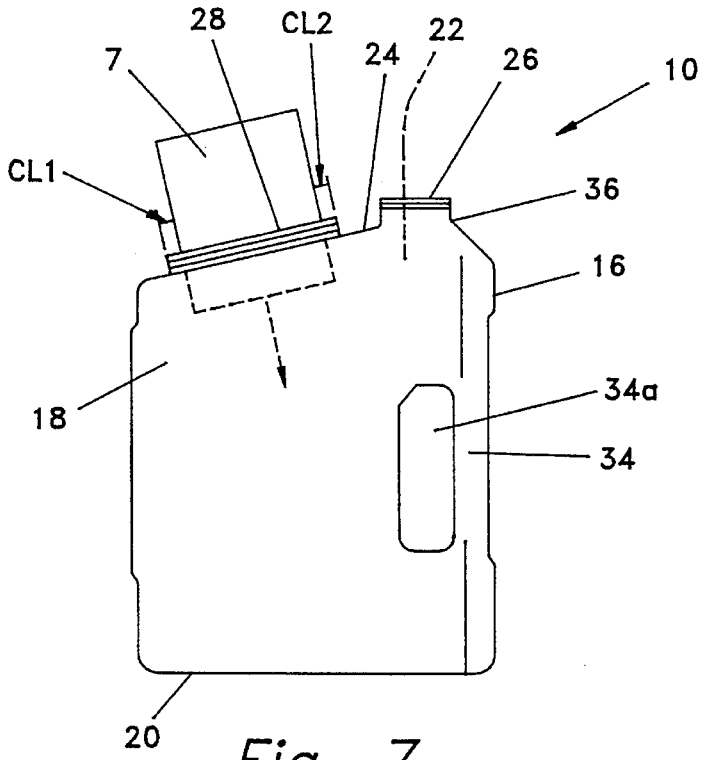
FIG. 7 is a side elevational view of the container, having the used oil filter being disposed therein.
Figure 8:
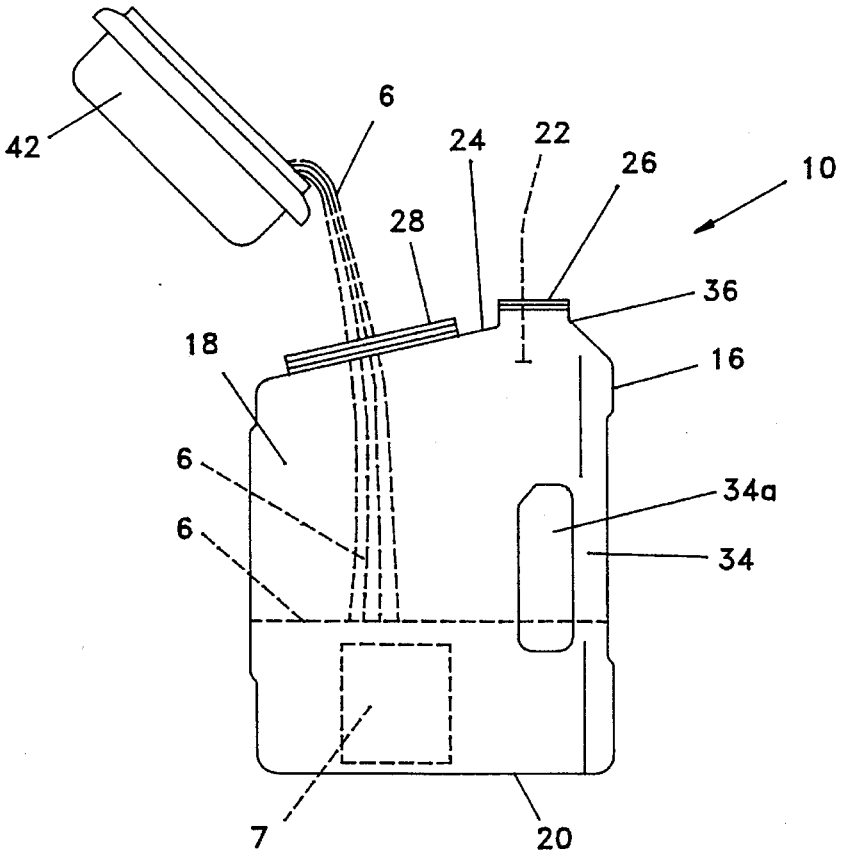
FIG. 8 is a side elevational view of the container, having used oil being poured from the catch pan into the container and immersing the used oil filter, which is represented in dashed lines.

Turning now to the drawings wherein similar parts of the invention are identified by like reference numbers, there is seen a preferred embodiment of the container of the invention which is generally illustrated as 10 in FIG. 1. The container 10 comprises a pair of opposed sides 12–14 secured to a pair of opposed ends 16–18, and a bottom 20 secured to the sides 12–14 and the ends 16–18 such that a cavity 22 is formed therein. The cavity 22 comprises sufficient volume to contain a requisite amount of a pertinent engine fluid. For example, if the container 10 is adapted for oil, the cavity 22 comprises sufficient volume therein to contain about 5 to 7 quarts of motor oil. Likewise, if the container 10 is adapted to engine coolant or transmission fluid, the cavity 22 comprises a volume sufficient to contain a suitable amount of engine coolant mix or transmission fluid. A top 24 is secured to the sides 12–14 and the ends 16–18, and a first aperture 26 and a second aperture 28 are disposed therein. A first cap 30 is adapted to being secured to the first aperture 26, by any suitable means, such as by threads, and a second cap 32 is likewise adapted to being secured to the second aperture 28. As best shown in FIGS. 7 and 8, apertures 26 and 28 directly face the bottom 20.

As shown by FIG. 1, the container 10 may additionally comprise a handle 34 that is integrated into the container. Handle 34, for the embodiment shown in FIG. 1, is formed from one end 16 of the pair of ends 16–18. A handle aperture **34*a* is formed in the container 10, such that a portion of end 16 comprises the handle 34, and aperture 34*a* provides an open area for grasping. As further shown by the embodiment depicted in FIG. 1, the top 24 of the container 10 comprises a slight angular disposition relative to the sides such that the first aperture 26 is situated at an apex 36 of the container 10 to allow for ease of flow of a liquid 2 contained therein. Preferably, the first aperture 26 of the container is dimensioned for allowing the liquid 5 (e.g., oil, engine coolant, or transmission fluid) to be poured therefrom at a controllable rate of flow (see FIG. 6). The second aperture 28 is dimensioned to allow an oil filter 4 or the like to be passed therethrough for storage in the container 10 (see FIG. 7**).

As best shown by FIG. 1, the first cap 30 and the second cap 32 are removably securable to the respective first and second apertures 26–28. Preferably, as shown by FIG. 1, the caps 30–32 are threadably secured to the container 10. The second aperture is dimensioned to allow a cylindrical filter 4 (such as an oil filter) to pass therethrough and subsequently be supported by the container (see FIG. 7).

The container 10 originates at an origin having fresh liquid 2 disposed therein and is transported to a destination where the liquid 2 (e.g., fresh oil, engine coolant, transmission fluid) contained therein is to be used. An engine 8 is typically located at the destination point, as the liquid 2 is generally an engine fluid. For the embodiment shown by the figures, fresh oil 3 is contained in the container 10 (see FIGS. 1 and 2), for the purpose of replacing used oil 6 contained in the engine 8. It is to be understood however, that the container 10 is intended to be used for any applicable fluid that may be transported and recycled, such as engine coolant, transmission fluid, or transmission oil.

Figure 2:
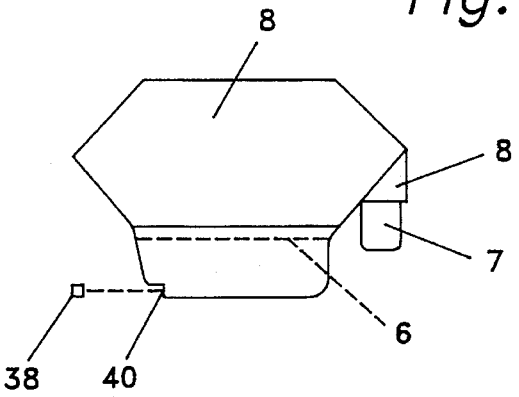
FIG. 2 is a side elevational view of an engine having dashed lines indicating a drain plug removed from a drain aperture thereof.
Figure 3:
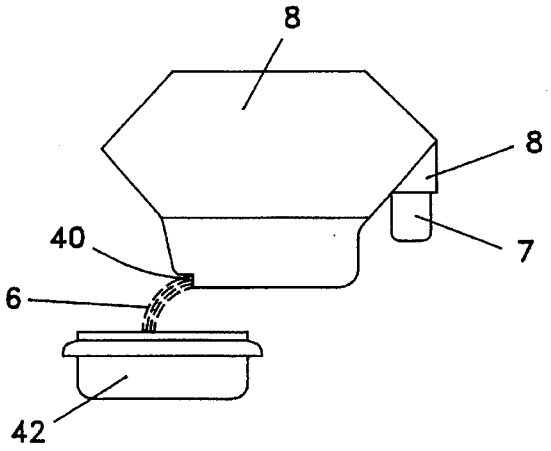
FIG. 3 is a side elevational view of the engine of FIG. 2 having a catch pan situated therebelow and wherein the dashed lines indicate used oil being drained from the engine into the catch pan.
Figure 4:
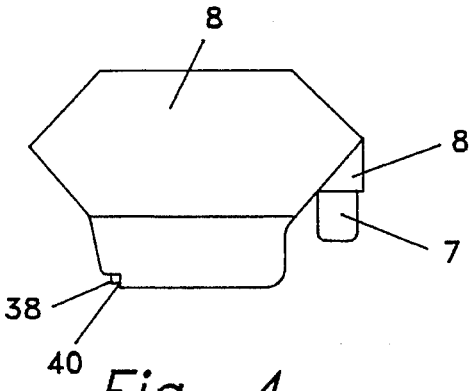
FIG. 4 is a side elevational view of the engine of FIG. 2 with the drain plug reinstalled in the drain aperture.
Figure 5:
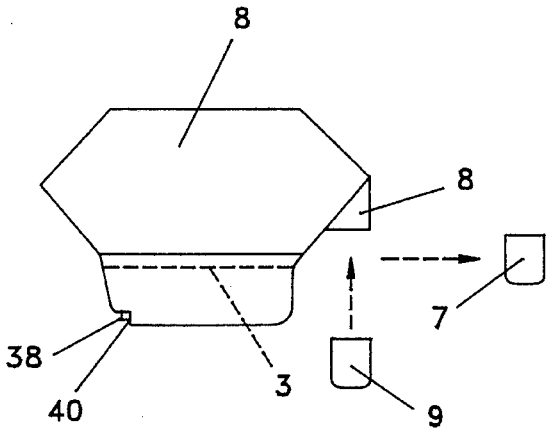
FIG. 5 is a side elevational view of the engine in FIG. 2 with a used oil filter being removed therefrom in direction of the horizontal dashed lines, and a new oil filter being installed in direction of the vertical dashed lines.

As best shown in FIGS. 2 and 3, a catch pan 42 is disposed in a position below a drain opening 40 of the engine 8, and a drain plug 38 is removed from the engine 8 to allow the used oil 6 contained therein to flow therefrom and into the catch pan 42. Used oil 6 is thus drained from engine 8 and stored temporarily in catch pan 42. As shown in FIG. 4, the drain plug 38 is reinserted in the drain opening 40, and the used filter 7, as shown in FIG. 5, is removed from the engine 8, as indicated by the arrow of the horizontal dashed line in FIG. 5. A new filter 9 is installed on the engine, as indicated by the arrow of the dashed vertical line in FIG. 5.

Figure 6:
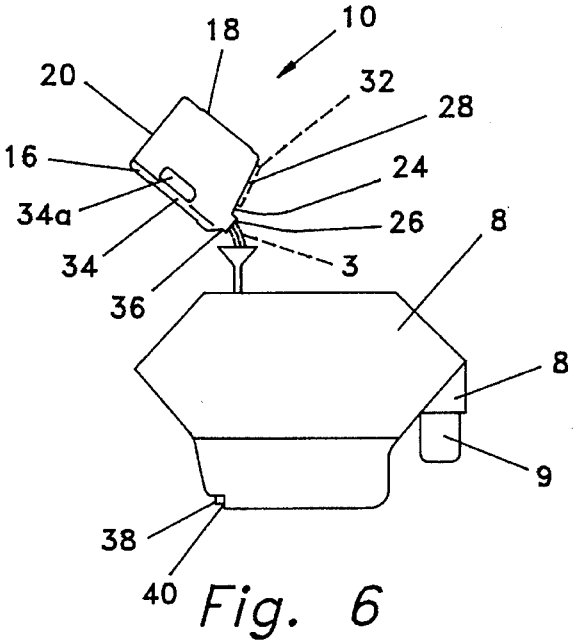
FIG. 6 is a side elevational view of the engine of FIG. 5 having the new oil filter installed and fresh oil being poured from the container into the engine.
Figure 9:
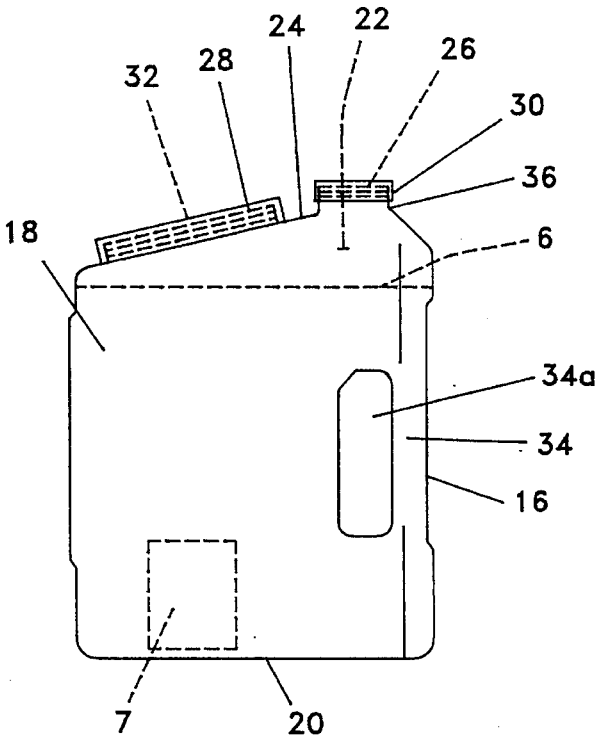
FIG. 9 is a side elevational view of the container with the first and second caps installed on the first and second apertures respectively and with the used oil filter being totally immersed in the used oil such that the container is ready to be returned to a point of origin.

First cap 30 is removed from first aperture 26 and fresh oil 3 is then poured from the container 10 into the engine 8, as shown in FIG. 6. A funnel or the like may be used to assist in the pouring process. Once the fresh oil 3 is substantially emptied from the container 10 into the engine 8, the used oil filter 7 is then inserted into the container 10 by removing second cap 32 from second aperture 28 thereof and passing the used filter 7 through the second aperture 28. As best shown in FIGS. 7 and 8 and 9, the used filter 7 is disposed on the bottom 20 of the container 10 such that the used filter 7 along with the bottom 20 directly faces the apertures 26 and 28. Used oil 6 is then poured through second aperture 28 into the container 10 from the catch pan 42, such that the used filter 7 contained in the container 10 becomes immersed in the used oil 6. The used filter 7 is preferably disposed in the container 10 before the used oil 6 to avoid splashing the used oil 6 from the container 10 by the used oil filter 7.

One of the salient features of the present invention is that the aperture 28 is formed to have a diameter ranging from about 4 1/16 inches to about 4 3/16 inches, preferably about 4 1/8 inches, to accommodate the largest automotive filter presently made which is about 4 inches OD, and such that the cap 32 (which is dimensioned to readily engage the threads circumscribing the aperture 28) may be easily handled with one hand and not be cumbersome. Caps approaching 5 to 6 to 8 inches are too large and unmanageable. Thus, for the largest automotive filter, the total clearance (i.e. $CL_1+CL_2$ shown in FIG. 7) ranges from about 1/16 inch to about 3/16 inch, more preferably about 1/8 inch.

The first cap 30 and the second cap 32 are replaced on respective first aperture 26 and second aperture 28, and the container 10 is returned to the origin (i.e., a service station, parts supplier, or the like). As previously mentioned, the container 10 may be used for transporting other engine fluids from an origin, such as engine coolant or transmission fluid, to a destination where an engine is located and subsequently transporting used fluid from the engine to the origin. Such a use, though not specifically shown in the drawings is specifically intended and should not unduly limit the scope and/or spirit of the invention.

Thus, by the practice of the present invention, there is provided a method for transporting fresh motor oil 3 from a point of origin to a destination point and for dispensing the fresh motor oil 3 into an engine 8 of a motor vehicle at the destination point and collecting used motor oil 6 and a used oil filter 7 from the engine 8 at the destination point and for transporting the used motor oil 6 and used filter back 7 to the point of origin, comprising the steps of: providing at the point of origin the generally hollow container 10 containing fresh motor oil 3 and including the first aperture 26 covered by the first cap 30 and secured to the container 10 and further including the second aperture 28 covered by the second cap 32 and secured to the container 10 (see step 1 in FIG. 1); transporting the container 10 from the point of origin to the destination point having the engine 8 containing the used motor oil 6 and the used oil filter 7; removing at the destination point the drain plug 38 from the drain opening 40 of the engine 8 such that the used motor oil 6 is capable of draining out (see step 2 in FIG. 2); draining the used motor oil 6 into the drain pan or catch pan 42 (see step 3 in FIG. 3); securing the drain plug 38 into the drain opening 40 of the engine 8 (see step 4 in FIG. 4); removing the first cap 30 off of the first aperture 26 of the container 10; removing at the destination point the used oil filter 7 from the engine 8 and securing the new filter 9 to the engine 8 (see step 5 in FIG. 5); pouring the fresh motor oil 3 contained in the container 10 through the first aperture 26 of the container and into the engine 8 while leaving the second cap 32 secured to the container 10 and covering the second aperture 28 (see step 6 in FIG. 6); removing the second cap 32 off of the second aperture 28 of the container 10; passing the removed used oil filter 7 through the second aperture 28 of the container 10 for disposing the removed used oil filter 7 in the container 10 (see step 7 in FIG. 7); pouring the used motor oil 6 from the drain pan or catch pan 42 and into the container 10 which contains the removed used oil filter 7 (see step 8 in FIG. 8); securing the first cap 30 to the container 10 and over the first aperture 26; securing the second cap 32 to the container 10 and over the second aperture 28 (see step 9 in FIG. 9); and returning the container 10, which includes the used oil filter 7 immersed in the used motor oil 6, to the point of origin.

While the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope of the invention as set forth.

I claim:

1. A method for transporting fresh liquids from an origin to a destination point and for dispensing the fresh liquids into an engine at the destination point and for collecting used liquids and used filters from the engine at the destination point and transporting the used liquids and used filters back to the origin, comprising the steps of:

(a) providing at an origin a generally hollow container containing fresh liquid and including a pair of opposed sides, a pair of opposed ends secured to said opposed sides, a bottom secured to said pair of opposed sides and to said opposed ends, and a top secured to said pair of opposed sides and to said opposed ends, said top having a structure defining a first aperture and a second aperture such that both said first aperture and said second aperture directly face said bottom, said first aperture hiring a first diameter and covered by a first cap that is secured to the container and said second aperture having a second diameter covered by a second cap that is secured to said container, said second diameter being dimensioned to receive therethrough a used filter;

(b) transporting said container of step (a) to a destination point having an engine containing used fluid and a used filter;

(c) draining at said destination point said used fluid from said engine of step (b);

(d) removing said first cap off of said first aperture of said container;

(e) removing at said destination point said used filter from said engine of step (b);

(f) pouring through said first aperture of said container and into said engine said fresh fluid contained within said container;

(g) removing said second cap off of said second aperture of said container;

(h) passing said removed used filter of step (e) through said second aperture of said container to dispose said removed used filter on said bottom of said container and such that said removed used filter along with said bottom directly faces said first and said second apertures;

(i) pouring said used fluid of step (c) into said container to immerse said used filter in said used fluid;

(j) securing said first cap to said container and over said first aperture;

(k) securing said second cap to said container and over said second aperture; and (l) returning said container, which includes said used filter immersed in said used fluid, to said origin of step (a).

2. The method of claim 1 wherein said pouring step (e) comprises pouring while leaving said second cap secured to said container and covering said second aperture.

3. The method of claim 1 wherein said pouring step (i) comprises pouring said used fluid through said second aperture of said container, and the method additionally comprises installing a new filter on the engine.

4. The method of claim 2 wherein said pouring step (i) comprises pouring said used fluid through said second aperture of said container.

5. The method of claim 1 wherein said first diameter is less than said second diameter.

6. The method of claim 4 wherein said first diameter is less than said second diameter.

7. The method of claim 1 additionally comprising forming said top of said container to have an apex wherethrough said first aperture is disposed and an angular disposition relative to said opposed sides of said container to allow for ease of flow of said fresh liquid through said first aperture.

8. The method of claim 5 wherein said second diameter has a value such that the total clearance from said removed used filter of step (h) ranges from about 1/16 inch to about 3/16 inch.

9. A method for transporting fresh motor oil from a point of origin to a destination point and for dispensing the fresh motor oil into an engine of a motor vehicle at the destination point and collecting used motor oil and a used oil filter from the engine at the destination point and for transporting the used motor oil and used filter back to the point of origin, comprising the steps of:

(a) providing at a point of origin a generally hollow container containing fresh motor oil and including a first aperture covered by a first cap secured to said container and a second aperture covered by a second cap secured to said container;

(b) transporting said container of step (a) from said point of origin to a destination point having an engine containing used motor oil and a used oil filter;

(c) removing at said destination point a drain plug from a drain opening of said engine such that the used motor oil is capable of draining out;

(d) draining said used motor oil into a drain pan;

(e) securing said drain plug into said drain opening of said engine;

(f) removing said first cap off of said first aperture of said container;

(g) removing at said destination point said used oil filter from said engine and securing a new filter to said engine;

(h) pouring said fresh motor oil contained in said container, through said first aperture of said container and into said engine;

(i) removing said second cap off of said second aperture of said container;

(j) passing said removed used oil filter of step (g) through said second aperture of said container for disposing said removed used oil filter in said container;

(k) pouring said used motor oil of step (d) from said drain pan and into said container of step (j) containing said removed used oil filter;

(l) securing said first cap to said container and over said first aperture;

(m) securing said second cap to said container and over said second aperture; and (n) returning said container, which includes said used oil filter immersed in said used motor oil, to said point of origin of step (a).

10. The method of claim 9 wherein said first aperture has a first diameter and said second aperture has a second diameter that is dimensioned for receiving therethrough said used oil filter.

11. The method of claim 10 wherein said first diameter is less than said second diameter.

12. The method of claim 10 wherein said pouring step (k) comprises pouring said used motor oil of step (d) from said drain pan, through said second aperture and into said container of step (j) containing said removed oil filter.

13. The method of claim 11 wherein said pouring step (k) comprises pouring said used motor oil of step (d) from said drain pan, through said second aperture and into said container of step (j) containing said removed oil filter.

14. The method of claim 9 wherein said pouring step (h) comprises pouring said fresh motor oil while leaving said second cap secured to said container and covering said second aperture.

15. The method of claim 13 wherein said pouring step (h) comprises pouring said fresh motor oil while leaving said second cap secured to said container and covering said second aperture.

16. The method of claim 15 wherein said second diameter has a value such that the total clearance from said removed used filter of step (j) ranges from about 1/16 inch to about 3/16 inch.

17. The method of claim 10 additionally comprising forming said generally hollow container to include a pair of opposed sides, a pair of opposed ends secured to said opposed sides, a bottom secured to said pair of opposed sides and to said opposed ends, and a top secured to said pair of opposed sides and to said opposed ends, said top having a structure defining said first aperture and said second aperture such that both said first aperture and said second aperture directly face said bottom, said first aperture having said first diameter and covered by said first cap that is secured to the container and said second aperture having said second diameter covered by said second cap that is secured to said container, said second diameter being dimensioned to receive therethrough a used filter.

18. The method of claim 17 additionally comprising forming said top of said container to have an apex wherethrough said first aperture is disposed and an angular disposition relative to said opposed sides of said container to allow for ease of flow of said fresh liquid through said first aperture.

19. A container for transporting fresh a pair of opposed sides, a pair of opposed ends secured to said opposed sides, a bottom secured to said pair of opposed sides and to said opposed ends, and a top secured to said pair of opposed sides and to said opposed ends, said top having a structure defining a first aperture and a second aperture such that both said first aperture and said second aperture directly face said bottom, said first aperture having a first diameter and covered by a first cap that is secured to the container and said second aperture having a second diameter covered by a second cap that is secured to said container, said second diameter being dimensioned to receive therethrough a used filter; said top further comprising an apex wherethrough said first aperture is disposed and an angular disposition relative to said opposed sides of said container to allow for ease of flow of said fresh liquid through said first aperture.

20. The container of claim 19 additionally comprising used motor oil and a used oil filter disposed therein.

* * * * *